United States Patent [19]

Wahoski

[11] 4,244,611

[45] Jan. 13, 1981

[54] BIAS OVER-CENTER LATCH WITH POSITIVE LOCKING FEATURE

[75] Inventor: Edward S. Wahoski, Kenosha, Wis.

[73] Assignee: International Harvester Company, Chicago, Ill.

[21] Appl. No.: 88,256

[22] Filed: Oct. 25, 1979

[51] Int. Cl.[3] ..... E05C 5/02

[52] U.S. Cl. ..... 292/113; 292/DIG. 49

[58] Field of Search ..... 292/113, 66, 129, 218, 292/DIG. 49, DIG. 31, 109, 63

[56] References Cited

U.S. PATENT DOCUMENTS

| | | | |
|---|---|---|---|
| 1,820,665 | 8/1931 | Hynes et al. | 292/113 |
| 1,931,298 | 10/1933 | Roossien et al. | 292/113 |
| 3,174,784 | 3/1965 | Swanson | 292/113 |
| 4,098,530 | 7/1978 | Edeus | 292/66 X |

*Primary Examiner*—Richard E. Moore

*Attorney, Agent, or Firm*—Ronald C. Kamp; F. David AuBuchon

[57] ABSTRACT

An over-center latch mechanism having a spring loaded link including a projecting rod. The rod having an "S" shaped bend on its free end which permits insertion and removal of said bend from an elongate slot only by actuation of the lever in the over-center mechanism.

4 Claims, 4 Drawing Figures

FIG. 1
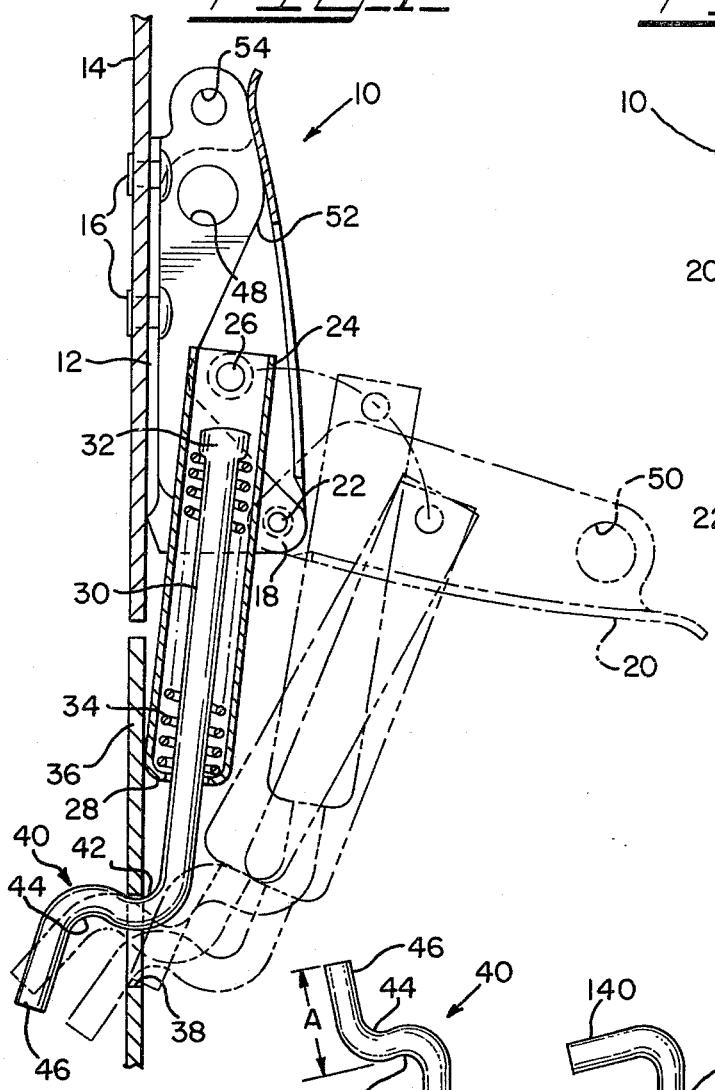
FIG. 2
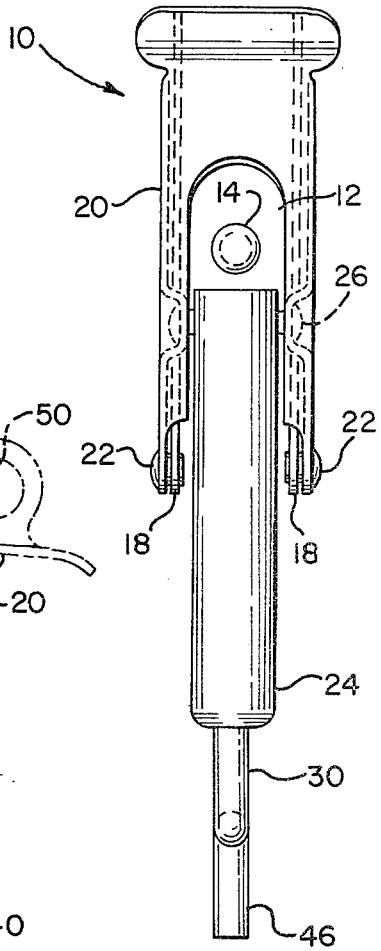
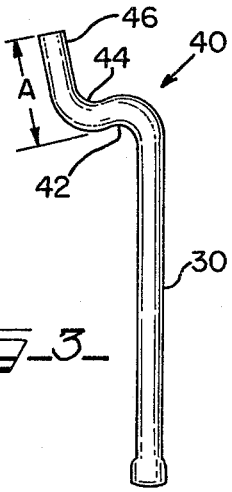
FIG. 3
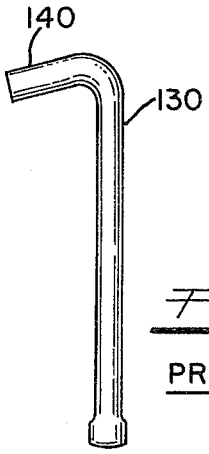
FIG. 4
PRIOR ART

BIAS OVER-CENTER LATCH WITH POSITIVE LOCKING FEATURE

BACKGROUND AND SUMMARY OF THE INVENTION

Certain types of machines, such as construction equipment for example, because of their size and/or the location and nature of the job sites on which they are used, are frequently left unattended. Vandalism and theft of component parts under such conditions has been a problem. For this reason, panels have been provided to shield and protect vital parts of the machine, such as the engine for example. Such panels must be moveable to permit servicing and repair or to permit operation of the machine. In order to accommodate variation due to manufacturing tolerances, and to reduce the vibration and the resulting noise when the machine is operated with the panel in place, it is desirable to provide a latch mechanism which includes a spring loaded element capable of exerting a bias force on the panel. Latch mechanisms of the prior art providing these attributes were deficient in that the very element which provided the bias force permitted defeating the lockable latch. That is, application of proper force to the latch could permit disengagement of the latch without removal of the lock holding the latch in its closed position.

It is therefore an object of this invention to provide a latch mechanism which is capable of exerting a bias force on the panel being latched and which is incapable of release without actuation of the latch mechanism.

It is also an object of this invention to provide a latch mechanism which is simple and economical to manufacture.

It is a further object of this invention to provide such a latch mechanism which permits a positive locking, which is vandal proof, and which is capable of ready manipulation.

These and other objects of the present invention will become more readily apparent upon perusal of the following detailed description and the accompanying drawings, wherein:

FIG. 1 a side view, partly in section, of a latch mechanism according to the present invention installed to secure a panel;

FIG. 2 is an elevational view of the latch mechanism shown in FIG. 1;

FIG. 3 is a detailed view of the rod portion of the latch mechanism in FIG. 1; and FIG. 4 is a view of the rod mechanisms according to the prior art.

DESCRIPTION OF A PREFERRED EMBODIMENT

Referring now to FIGS. 1 and 2, a latch, indicated generally at 10, has a base portion 12 affixed to a panel 14, which panel may be a moveable panel, by fastening means such as rivets 16. A pair of upright ears 18 are formed on the base portion 12. A lever 20 is pivotally attached to the ears 18 by means of pivot pins 22. A cylindrical tube 24 is pivotally attached to the lever 20 by means of a pin 26. The tube 24 is provided with a partially enclosed end 28 through which a latch rod 30 extends. The latch rod is provided with an enlarged end 32, which may for convenience be formed by flattening the cylindrical latch rod 30. A compression spring 34 is trapped inside the tube 24 between the partially enclosed end 28 and the enlarged end 32 of the rod 30. The latch rod 30 is thereby urged by the compression spring 34 into engagement with the pin 26, which pin thereby serves to retain both the spring and the latch rod 30 within the cylindrical tube 24, the tube 24, the rod 30 and the spring 34 functioning as a spring-loaded link.

The location of the pivot pins 22 on the ears 18 is further from the plane of the panel 14 than is the pin 26 when the lever 20 is moved to its limit toward the panel 14. Such an arrangement is conventional and is commonly called an over center mechanism because the line of action of the latch rod must pass through the axis of the pivot pins 22 as the lever is moved between its fully closed position adjacent the panel and its fully opened position remote from the panel 14.

A second panel 36, which preferably is the stationary panel, is provided with a slot 38 through which the hook end 40 of the rod 30 may be inserted. The conventional or prior art rod 130, as shown in FIG. 4, was provided with a simple hook end 140, a single bend which extended at an angle less than 90 degrees from the main axis of the latch rod 130. It is apparent that by simply exerting a force to compress the spring 34, the hook end 140 of latch rod 130 could readily be removed from the slot 38.

The latch rod 30 of the present invention has a hook end 40 which comprises an S-shaped bend formed by a first bend 42 toward the base 12 and a second bend 44, in the same plane, away from the base 12. The hook end 40 terminates on a tang 46 which has sufficient length to prevent removal of the hook end from the slot 38 when the lever 20 is in its latched position adjacent the base portion 12, as illustrated by the solid line position thereof in FIG. 1. However, the length of the tang 46 is not so long as to inhibit removal of the hook end from the slot 38 when the lever 20 is moved to its dotted line position in FIG. 1. In order to achieve this functional relationship, the physical correlation of the slot 38 to the latch rod 30 is important. The slot 38 must have a width slightly greater than the diameter of the latch rod 30 and a length less than the length of the tang 46, the length of the tang 46 being measured from the apex of the outside fibers of the second bend 44 to the free end of the tang 46. This length is shown in FIG. 3 as dimension A. While the tang 46 is shown as being at an angle of about 10° to the main axis of the rod 30, to facilitate ingress and egress through the slot 38, the tang 46 may be made with its axis parallel to the major axis of the rod 30.

In order to retain the lever 20 in its latched position, apertures 50 are provided therein which are registerable with apertures 48 provided in upturned flanges 52 formed on the base member 12. The apertures 48 and 50 are aligned when the lever 20 is moved to its latch position as shown in solid lines in FIG. 1. By insertion and removal of the shackle of a pad lock through the apertures, the bias latch may be respectively locked and unlocked.

A second aperture 54 in at least one of the flanges 52, permits the attachment of a chain to function as a tether for the pad lock during those times when it is desired to have the latch unlocked.

While a preferred embodiment of the present invention has been shown and described herein, it will be appreciated that various changes and modifications may be made without departing from the spirit of the invention as defined by the scope of the appended claims.

What is claimed is:

1. In an over-center latch mechanism for latching two relatively immoveable panel members, one of said panel members having an elongated slot, said mechanism having a base member including a pair of outward-projecting ears affixed to the other of said panel members, a lever pivotally attached to said ears and including a pair of side flanges and an extension for operator manipulation thereof, a cylindrical tube, a pin extending through said flanges and said tube for pivotal attachment of said tube to said lever, a cylindrical rod having an enlarged head on one end and the other end projecting beyond said tube, a washer on said rod, and a compression spring trapped inside said tube and urging said washer against said enlarged end; the improvement comprising:

an S-shaped bend formed on said other end of said rod and capable of insertion through said elongated slot, said bend having a shape and length such that removal of said bend from said slot is possible only in conjunction with manipulation of said lever.

2. In an over-center latch mechanism according to claim 1, wherein:

said tang has a length greater than the length of said slot.

3. In an over-center latch mechanism according to claim 2, wherein:

said tang has a width less than the width of said slot.

4. In an over-center latch mechanism according to claim 3, wherein:

said tang forms an angle of approximately 10° with said rod.

* * * * *